US005967219A

United States Patent [19]

Lumppio

[11] Patent Number: 5,967,219

[45] **Date of Patent: *Oct. 19, 1999**

[54] METHOD AND APPARATUS FOR POURING MOLTEN MATERIAL

[75] Inventor: Juha Lauri Lumppio, Espoo, Finland

[73] Assignee: Wenmec Systems OY, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/639,346

[22] Filed: May 1, 1996

[30] Foreign Application Priority Data

May 9, 1995 [FI] Finland ..... 952239

[51] Int. Cl.[6] ..... B22D 35/00

[52] U.S. Cl. ..... 164/136; 222/604

[58] Field of Search ..... 164/136, 335, 164/437; 222/594, 604, 605

[56] References Cited

U.S. PATENT DOCUMENTS 1,536,654 5/1925 Browne ..... 222/604

FOREIGN PATENT DOCUMENTS 908517 2/1982 U.S.S.R. ..... 222/604

*Primary Examiner*—Kuang Y. Lin

*Attorney, Agent, or Firm*—Morgan & Finnegan

[57] ABSTRACT

The present invention relates to a method and apparatus for pouring molten material, such as molten metal, into a casting mold so that the amount of melt can be weighed in connection with the pouring. In order to keep the pouring height of the molten material low and its motion as smooth as possible during the pouring step, the bottom of the ladle containing molten material is designed to be essentially curved, with such a radius of curvature that the thickness of the molten layer located in the ladle is, even at its thickest, only a fraction of the length of the radius of curvature of the bottom. The casting method of the invention is advantageously realized by means of a cradle arrangement of the ladle according to the invention.

5 Claims, 3 Drawing Sheets

1
2
3
4
6
7
8
9
10
11
12
13
14

1
2
3
4
6''
7
8
9
10
11
12
13
14

METHOD AND APPARATUS FOR POURING MOLTEN MATERIAL

BACKGROUND OF THE INVENTION

The present invention relates to a method and apparatus for pouring molten material, such as molten metal, into a casting mold so that the amount of molten material can be weighed in connection with the pouring. In order to keep the pouring height of the molten material low and its motion as even as possible during the casting operation, the bottom of the ladle containing the molten material is designed to be essentially curved, having such a radius of curvature that the thickness of the molten layer located in the ladle is, even at maximum, only a fraction of the radius of curvature of the bottom. The casting method of the invention is advantageously realized by means of a ladle bearing apparatus according to the invention.

The casting of molten metal and its weighing in the same connection is essential for instance when casting metal anodes, because the next process step after casting is electrolysis, where one prerequisite for achieving a high efficiency is a uniform quality of the anodes, with respect to both shape and weight. In most known methods, anodes are nowadays cast in open molds.

Anode casting is generally accomplished by inclining the ladle by means of a hydraulic cylinder, which tilts the cradle on top of which the ladle is arranged. The cradle and the other end of the hydraulic cylinder are attached with bearings to a bridge. The cradle, the hydraulic cylinder and the bridge float on top of a complex leverage, which transforms the vertical forces directed to the ladle to a force which can be measured by one or several traction sensors.

In the prior art there is known a method and apparatus described in the Canadian patent 924,477 for weighing molten material in connection with pouring. This patent introduces a ladle with a curved bottom, wherein the height of the molten layer at the beginning of the casting process is of the same magnitude as the radius of curvature of the bottom. When the height of the ladle is of the order of the radius of curvature, the ladle must, during casting, be shifted on top of the mold. This type of solution is difficult to construct, if the ladle is supported from underneath, as is customary with ladles at present. It is also clear that the pouring height of the molten material becomes remarkably great, and this makes it splash. The U.S. Pat. No. 3,659,644 describes a similar type of ladle where the height of the ladle is of the same order as the radius of curvature.

In the prior art there are also known other arrangements which combine the pouring and weighing of molten material, and where the bottom of the ladle is essentially flat. In these arrangements, the pouring height of molten material is low. In some cases, the accelerating of molten material into motion from the flat bottom of the ladle may cause an erroneous impression of increased mass in the weighing sensor.

BRIEF SUMMARY OF THE INVENTION

In order to minimize possible weighing errors in connection with pouring molten material and to achieve a casting process which proceeds as smoothly as possible, so that the pouring height of the molten material remains low and its motion as even as possible, there is now invented a ladle which is essentially curved at the bottom, where the thickness of the molten layer, when measured vertically prior to casting, is only a fraction of the length of the radius of curvature, ½ of it at the most, but advantageously within the range of ⅓–⅕. There is also developed an apparatus for moving this ladle. The essential novel features of the invention are apparent from the appended claims.

A ladle that enables a smooth casting process can also be described by means of the angle of the segment formed by the molten metal located in the ladle. In that case the segment angle is 140° at most, advantageously 90° at most. Segment here means an angle formed in between the center of curvature of the ladle and the straight lines drawn from both edges of molten copper.

In the novel apparatus, the ladle bottom is formed to be curved and the ladle is inclined around the straight line passing through the center of the radius of curvature of the bottom. Now molten material, such as metal, does not have to be accelerated into motion, but it remains almost in place, depending on the viscosity of the metal in question. Thus the method does not transmit an erroneous message of changed mass to the weighing mechanism. When staying at the bottom of the ladle, the molten metal does not gain momentum to any direction, and its splashing in the ladle is reduced.

When a given amount of molten metal is fed into the ladle, which amount generally is anode weight+backing metal, and it is observed that the anode width determines the width of the ladle, there is obtained a certain area. Research has now shown that the smaller the radius of the ladle bottom is in relation to the thickness of the molten metal layer, the nearer to the front edge of the mold the rotational axis of the ladle is shifted. For instance, if the ratio of the radius of the ladle bottom to the molten layer is 1:1, this means that during the pouring step, the ladle must in practice be located on top of the mold. Such a ladle is fairly difficult to support, and particularly the application of a scale in this arrangement is difficult. When the radius of curvature of the ladle bottom is large in relation to the thickness of the molten layer, the center of gravity of the molten metal and of the ladle are located outside the mold. In this case the scale and the tilting mechanism are realized much more easily.

Other advantages of the method of the present invention are that because the height of the molten metal layer in the ladle is low, the pouring height from the ladle to the mold remains low throughout the pouring operation. This fact is particularly important at the beginning of the pouring, when molten metal tends to splash from the empty mold.

BRIEF DESCRIPTION OF THE DRAWINGS

The apparatus of the invention is described in more detail with reference to the accompanying drawings, where.

DETAILED DESCRIPTION OF THE INVENTION

Figure 1A:
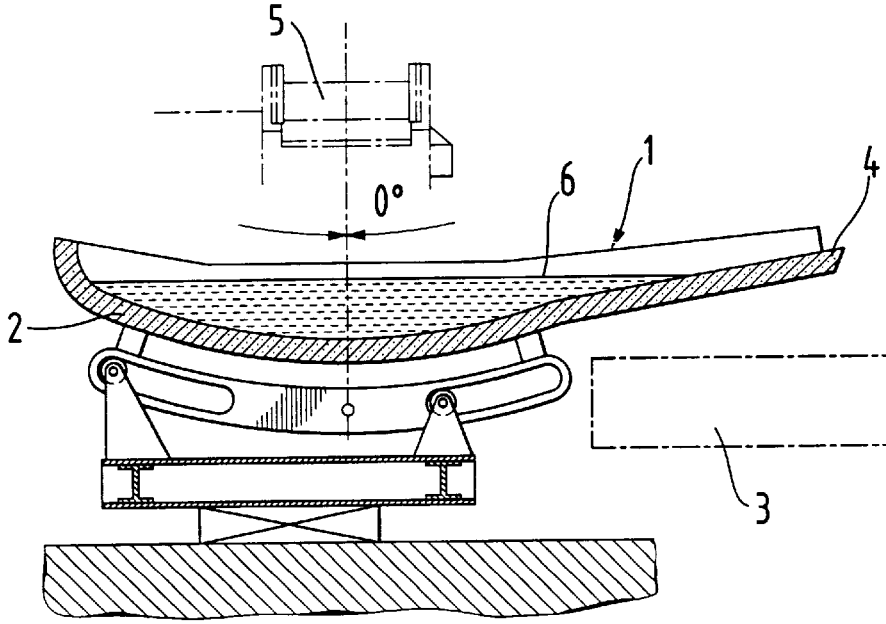
FIG. 1 illustrates the principle of the ladle of the invention at various stages of inclination.

FIG. 1A illustrates a ladle 1 according to the invention, provided with a curved bottom enabling a smooth pouring operation, in a position where it is not yet inclined, i.e. the inclination is 0°. The ladle has a curved bottom 2 and a pouring spout 4 directed towards the mold 3. Above the ladle there is provided the intermediate ladle 5, wherefrom molten material is poured into the ladle. The surface of the molten material is designated with number 6. The drawing does not illustrate the side walls of the ladle in more detail, but advantageously said walls are essentially vertical. In the different alternatives of FIG. 1, the thickness of the molten layer prior to the beginning of the casting, when measured vertically, is less than 1/10 of the radius of curvature of the ladle bottom.

Figure 1B:
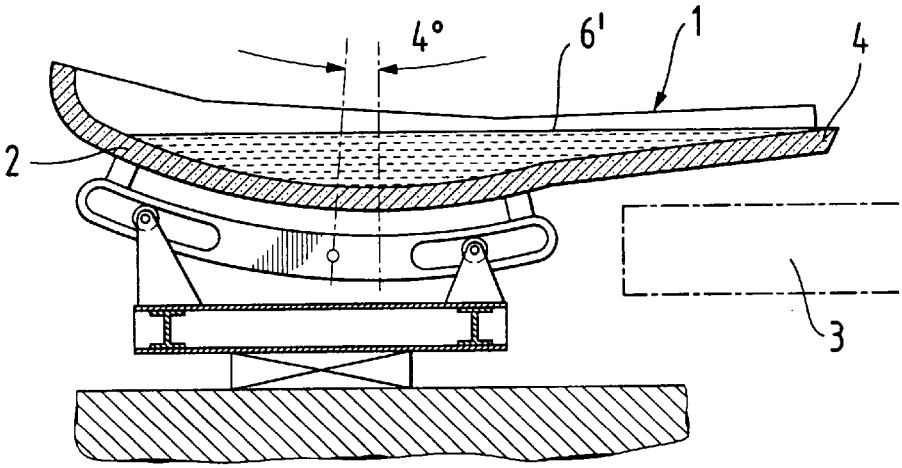

In FIG. 1B, the ladle is inclined to such an extent—in the drawing 4°—that the surface 6' of molten metal already extends to the tip of the pouring spout 4, and thus the pouring has begun.

Figure 1C:
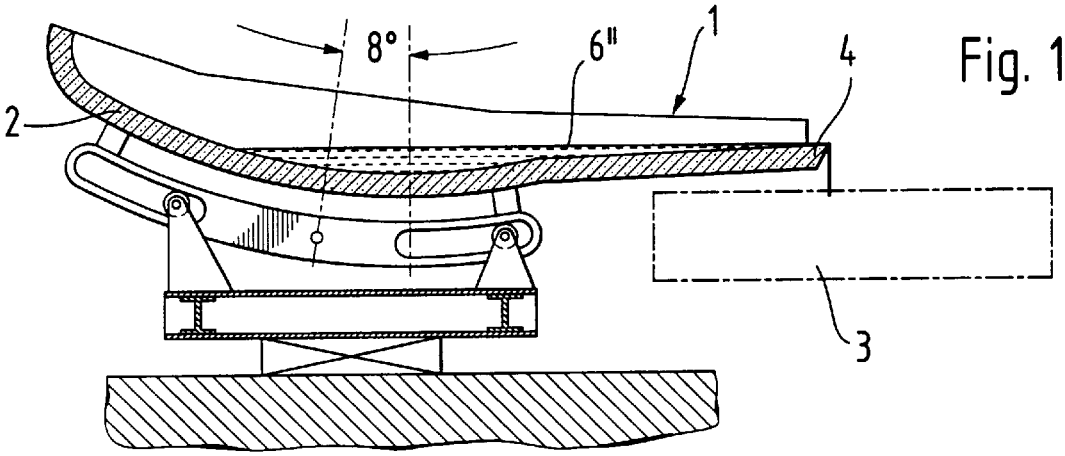

In FIG. 1C, the casting proceeds, and the inclination in this case is 8°. When comparing figures B and C it is seen how the position of the pouring spout in relation to the casting mold is shifted.

As is seen from the different steps of FIG. 1, the tip of the pouring spout moves horizontally during casting. It is another essential feature of the method that during a casting cycle, horizontal motion is larger than vertical motion. Horizontal motion is advantageous from the point of view of the anode mold, because it increases the working life of the mold and the coating and reduces local temperature peaks when the melt hits the mold. When the point where the molten metal hits the mold shifts in the course of the casting process, the effects are distributed on a larger area, and therefore the working life of the molds is lengthened.

Figure 2:
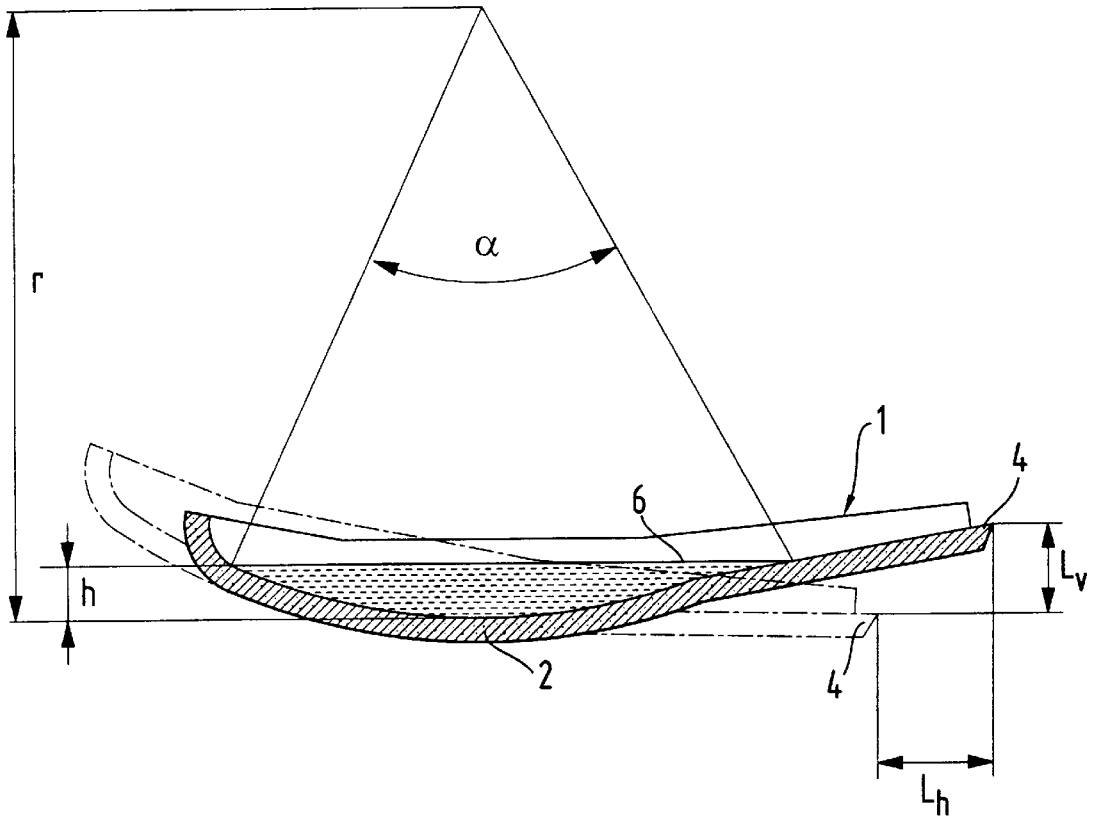
FIG. 2 illustrates the magnitudes used in defining a ladle with a curved bottom.

FIG. 2 illustrates some factors for determining the height of the molten layer in a ladle with a curved bottom. Accordingly, r=the radius of the curved bottom 2 of the ladle 1, and h=the height of the molten metal layer when measured vertically (=at the thickest point). The angle of the segment formed by the molten metal in its ladle=$\alpha$. The horizontal motion of the pouring spout of the ladle from the beginning to the end of the pouring of molten metal is described with the term $L_h$ and the vertical motion with the term $L_v$. The ladle bottom, drawn with a continuous line, describes the position of the ladle at the beginning of the casting, and the dotted line describes its position at the end of the casting.

The moving of a ladle with a curved bottom mainly creates horizontal motional forces. Motional velocities, i.e. pouring speed, can also be increased without causing any significant interference in the measurements.

Because the height of the molten layer located in the ladle is only a fraction, ½ at the most, of the length of the radius of curvature of the ladle bottom, a low pouring height and an extremely good weighing accuracy can be achieved by using this structure. Owing to the magnitude of the radius of curvature, the ladle is not lifted at one end, but it is rather moved on an essentially horizontal level, in which case the ladle moving forces are small, and the vertical shift of the central mass point of the ladle remains extremely slight in the vertical direction. Thus the shifting of the central mass point of the ladle does not cause erroneous information to the effect of a momentary increase in the mass.

The gearing of a ladle with a curved bottom must be arranged differently than that of a ladle with a flat bottom. The pouring mechanism constitutes part of the mass to be weighed, and it should be as light as possible. In practice this means that the ladle must be supported from underneath, so that the forces can be conducted to the sensor via the shortest route possible. Support from underneath is the best solution also because the ladle is filled at either side or at the end, and obstructing structures must not be on the way. If gearing structures are placed above the ladle, their protection against heat and splashes causes problems and increases weight.

Figure 3A:
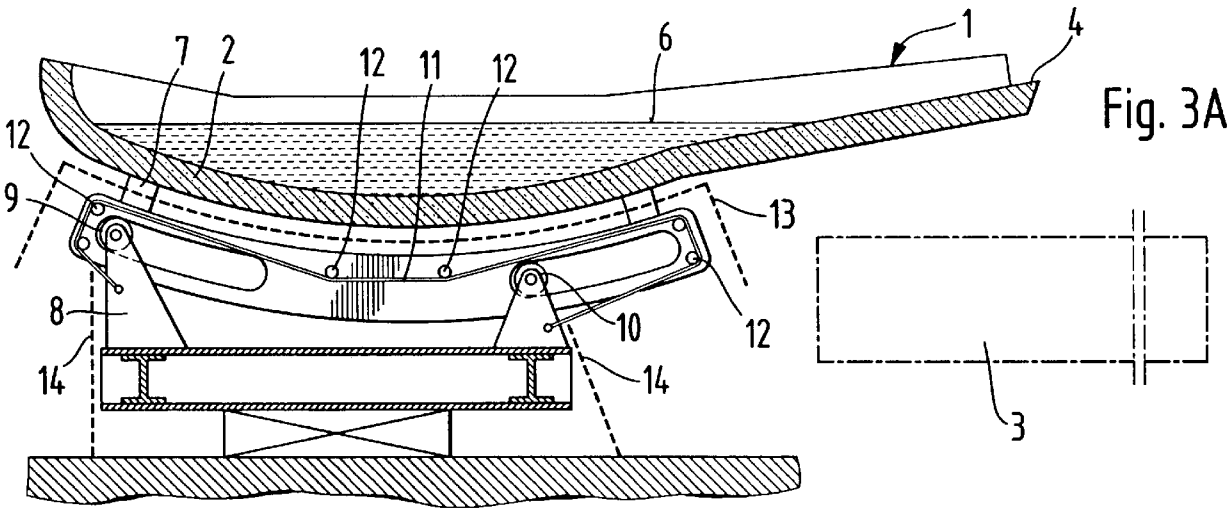
FIG. 3 illustrates the principle of an advantageous way of gearing the ladle of the invention.
Figure 3B:
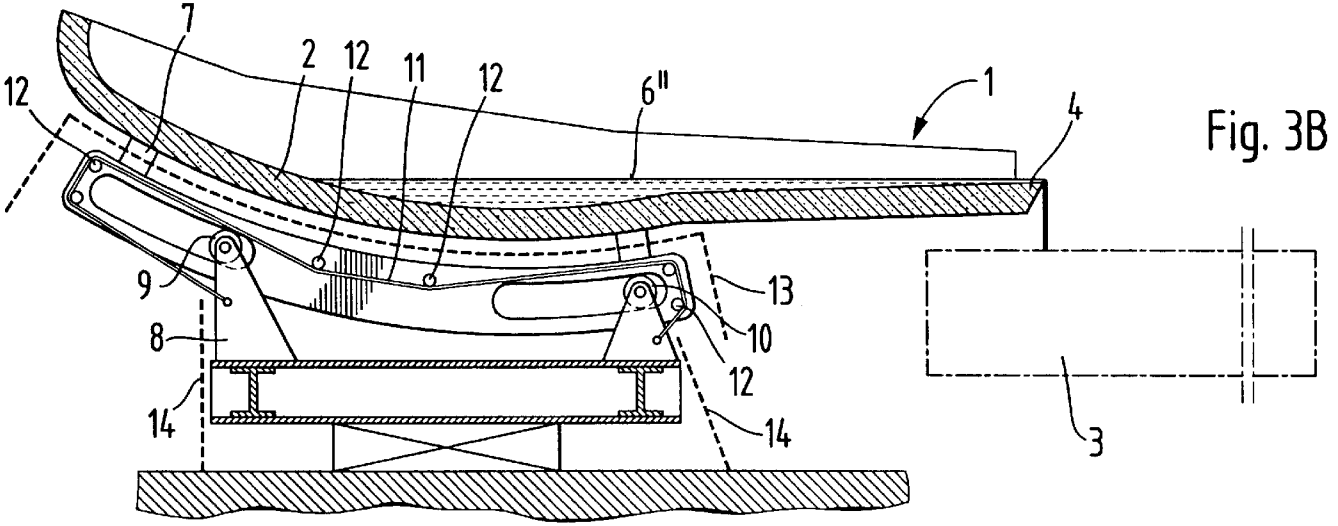

FIG. 3 illustrates an advantageous fashion of gearing the ladle 1. In FIG. 3A, the ladle is in its initial position (inclination angle 0°) and in FIG. 3B it is inclined to the maximum. The ladle 1 is placed in a moving cradle 7, formed of at least one curved beam, provided with a machined, suitably curved groove for realizing the trajectory circling the center of curvature of the ladle bottom. The bearing rollers 9 and 10 arranged in the scale frame 8 move along said trajectory. By means of a steel spring fillet 11, which rotates around the pins 12 provided in the cradle 7 and is attached to the frame 8 at both ends, the guide bars can be protected so that open apertures are of the order of a few millimeters only, while the scale is otherwise covered with protective lids 13 and 14. It is important to protect the scale properly against metal splashes, because practice has shown that over a period of time, metal particles penetrate into nearly all possible places. Apart from a curved groove, the trajectory operating around the center of curvature of the ladle bottom can be realized in some other suitable fashion, too, for instance by using several rollers and a guide bar.

The above described structure is advantageously realized so that the rollers are stationary and the guide bars move. The center of gravity then remains constantly in between the rollers and the guide bars serve as the structure of the cradle, which helps lighten the weight of the mechanism. Moreover, the contact surface of the guide bars with the rollers is the top surface, so that dirt is not accumulated on the guide bars.

The cradle of the ladle can also be constructed so that the protecting fillet 11 is at one end attached to the frame 8 and at the other end to the cradle 7 by means of a flexible element that allows a stretch of the same magnitude as the extent of the pouring motion.

The ladle and the molten metal contained therein does not have to be lifted, but the ladle is mainly rolled backwards during the pouring step, and therefore the moving of the ladle requires fairly little force. This fact allows for planning several different actuators for moving the ladle.

The pouring method of the present invention can be applied to the dosing of all liquid materials, where the liquid should also be weighed in connection with the pouring. The liquids mainly in question are those which cannot be regulated by valves and flow meters. Such liquids are for instance hot molten metals.

The construction of the ladle described above is designed so that it can be installed to old casting units, too.

What is claimed is:

1. A method of pouring a molten material into a casting, mold from a ladle which comprises providing a ladle having a pouring spout and a curved bottom with a length of a radius of curvature r, maintaining a level of molten material in said ladle to a depth h such that the ratio h to r is not greater than 1:2 thereby forming a cradle for said molten material, moving said cradle in a manner such that during pouring, the horizontal motion $L_h$ of the pouring spout during the interval between the beginning and end of the pouring step is greater than the vertical motion $L_v$ of the pouring spout.

2. A method according to claim 1 wherein the ratio of the height h of the molten material layer located in the ladle prior to pouring, when measured vertically, to radius of curvature r is ⅓ at the most.

3. A method according to claim 1 wherein the ratio of the height h of the molten material layer located in the ladle prior to pouring, when measured vertically, to radius of curvature r is ⅕ at the most.

4. A process as defined in claim 1 wherein the molten material is poured by filling the ladle so that the bottom of the ladle follows a trajectory about the center of curvature and so that the angle $\alpha$ of radius r subtended by the molten material in the ladle prior to pouring is 140° at the most.

5. A method according to claim 4, wherein angle $\alpha$ formed by the molten material in the ladle is 90° at the most.

* * * * *